United States Patent [19]

Shaw

[11] Patent Number: 4,467,891

[45] Date of Patent: Aug. 28, 1984

[54] LOCK MECHANISM FOR EXTENSION LADDER

[75] Inventor: Jonathan L. Shaw, Clinton Township, Hunterdon County, N.J.

[73] Assignee: AT&T Technologies, Inc., New York, N.Y.

[21] Appl. No.: 508,400

[22] Filed: Jun. 27, 1983

[51] Int. Cl.[3] ..... E06C 7/06

[52] U.S. Cl. ..... 182/210

[58] Field of Search ..... 182/209, 210, 211, 212, 182/213, 66, 67

[56] References Cited

U.S. PATENT DOCUMENTS

| | | | |
|---|---|---|---|
| 457,805 | 8/1891 | Whittington | 182/210 |
| 523,848 | 7/1894 | Bushnell | 182/211 |
| 679,385 | 7/1901 | Klemme et al. | 182/210 |
| 4,299,306 | 11/1981 | Hawkins | 182/210 |

*Primary Examiner*—Reinaldo P. Machado
*Attorney, Agent, or Firm*—R. F. Kip, Jr.

[57] ABSTRACT

There is disclosed a releasable lock mechanism for an extension ladder comprising a bell crank lever attachable to a fly rail of the ladder through a first pivot, and having first and second joined arm segments extending generally forward and downward, respectively, from their juncture. The first arm segment has at its front a head movable by pivoting of the lever between first and second positions at which the head will and will not, respectively, engage base rungs of the ladder. A tongue with a tip is attached to a lower part of the lever's second arm segment through a second pivot. Attachable to the rail is a frame operable during downsliding of the ladder's fly section to guide translatory movement of the tongue so that strikings of its tip by base rungs of the ladder are effective to pivot the lever to permit its head to pass by such rungs. When the lever head engages the top of a base rung to lock the fly section from downsliding, the tongue is held against flapping about the second pivot.

27 Claims, 10 Drawing Figures

LOCK MECHANISM FOR EXTENSION LADDER

TECHNICAL FIELD

This invention relates to the art of extension ladders. More particularly, this invention relates to mechanisms for such a ladder which are adapted to lock the extended fly section to the base section to preclude downward sliding of the former or, when desired, to release the locking action to thereby permit downward sliding of the fly section.

BACKGROUND OF THE INVENTION

Lock mechanisms which perform the function described have long been known in the art. For example, U.S. Pat. No. 679,385 issued July 30, 1901 in the name of Klemme et al. ("Klemme") discloses such a mechanism comprising a hook pivotally coupled at its upper end to a fly rail of the ladder and, at its lower end, having an upside down "U" recess defined between downwardly extending prongs of the hook which are inner and outer, respectively, relative to the base section of the ladder. A keeper lever is pivotally coupled to the lower end of the outer prong and extends therefrom to an upwardly tilted keeper tip. The keeper is weighted to normally close the opening of the hook's "U" recess in such manner that the tip projects beyond the hook's inner prong. That prong is adapted by engaging the inner side of a base rung during downsliding of the fly section to be wedged outwardly to pass by the rung.

With the inner prong and the tip engaging the inner and under sides, respectively, of a base rung of the ladder, a slight lifting of the fly rail will pivot the keeper away from the "U" recess opening and, also, raise the hook's inner prong above the base rung, thereby to permit the hook to swing under gravity about its pivot to position the "U" recess over such rung. With the recess so positioned, subsequent lowering of the rail will bring such rung into contact with the hook wall bounding the upper portion of the "U" recess to shift the weight of the fly section through the hook and contacted base rung to the ladder's base section to thereby preclude further downward movement of the fly section. If, prior to such slight lifting, the fly section is moved up one or more rung interspaces, the hook will pass by one or more higher rungs (by outward wedging of the inner prong) and then may be locked to one of them.

If, on the other hand, the fly rail is lifted enough from the starting position described above to cause the keeper tip to pass by and disengage with the base rung, then the keeper pivots upwards to bear against the hook's inner prong and close the hook's recess, and, on subsequent lowering of the fly rail, the keeper tip will engage the top of the underlying base rung to be wedged outwardly thereby so that the keeper pivots the hook to displace its inner prong outward to the point where the rung will pass by both such prong and the keeper. The hook then pivots back inwardly under gravity to position the keeper tip over the next lower base rung. Continued lowering of the fly section produces reiteration of the hook and keeper actions just described so that the hook and keeper may be passed by a plurality of base rungs.

The Klemme hook-and-keeper arrangement has, with variants in structure, been widely adopted and is in common use in present day extension ladders. Such hook-and-keeper arrangements require however that the pivot for the hook be located at a substantial distance above the adjacent lower fly rung on the fly rail, and this leads to the disadvantage (among others) that the hook must be large in size to the point where the arrangement is bulky, tends to get in the way of the ladder user and may require omission of a fly rung from the fly section in order to mount the arrangement on a fly rail.

SUMMARY OF THE INVENTION

In contrast to the foregoing, an extension ladder lock mechanism according to the invention comprises a rung locking lever attachable to a fly rail of the ladder through a first pivot and having a head spaced from such pivot by a first moment arm primarily normal to such rail when the head is in an uppermost limit position, a lock releasing tongue having a tip at one end and attached at its other end to such lever through a second pivot spaced from such first pivot by a second moment arm, and tongue guide means attachable in fixed relation to the fly rail and operable to guide translational movement of the tongue during downward sliding of the fly section of the ladder. Such elements of a mechanism according to the invention are adapted to cooperate as follows. With the head of the lever being in its uppermost limit position, the head is adapted by bearing on the top of a base rung to lock the fly section to the base section to preclude downward sliding of the fly section. In response to continuous rising of the fly section, the head will strike the bottoms of successive base rungs to produce successive pivotings of the lever enabling it to pass those rungs. If, after the lever has been raised above a base rung by less than the amount needed for the tip of the tongue to clear that rung, and the fly section is then lowered, the lever head will settle on that rung to lock the fly section to the base section as described. If, however, the lever is raised by more than that amount and the fly section is then lowered, the tip of the tongue will be struck by such rung to be driven thereby upward relative to the lever head, and such upward driving of the tip is converted by the guiding of the tongue in translational movement by the tongue guide means into a pivoting of the lever which shifts its head downward to enable the head and lever to pass by that rung and, by reiteration, one or more other base rungs.

BRIEF DESCRIPTION OF THE DRAWINGS

For a better understanding of the invention, reference is made to the following description of an exemplary embodiment thereof and to the accompanying drawings wherein.

Figure 1:
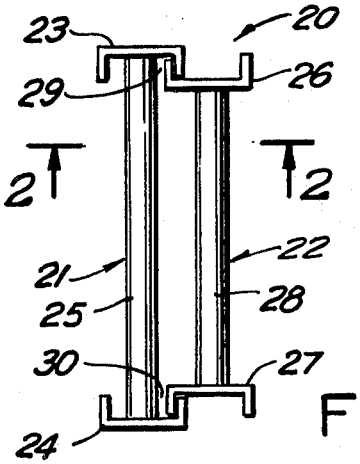
FIG. 1 is a plan view of the top of a conventional extension ladder in vertical position.
Figure 5:
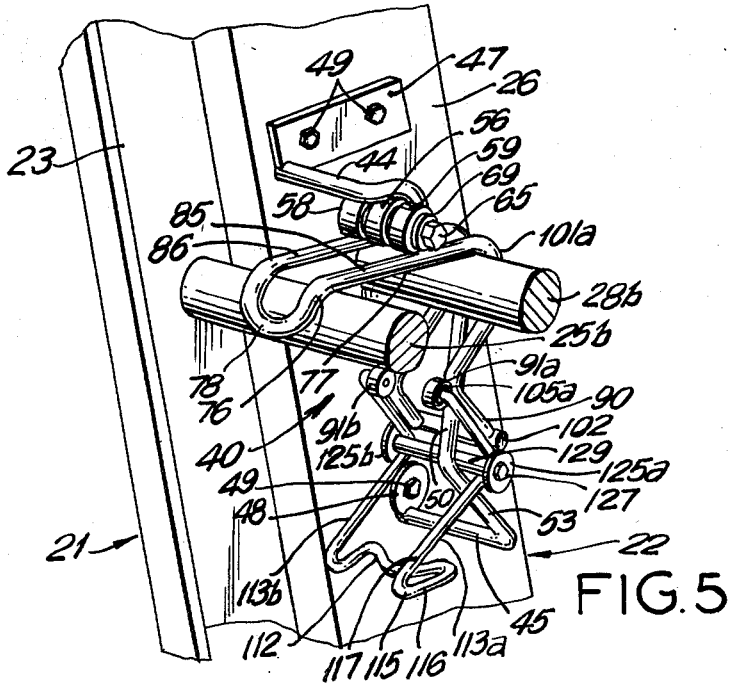
FIG. 5 is an isometric view of the FIG. 3 mechanism as mounted on said right fly rail of the FIG. 1 ladder when tilted to be in working position, the mechanism being in a position to lock the fly section of the FIG. 1 ladder from downward sliding, only broken-away sections of the fly rail and base rail being shown.
Figure 6:
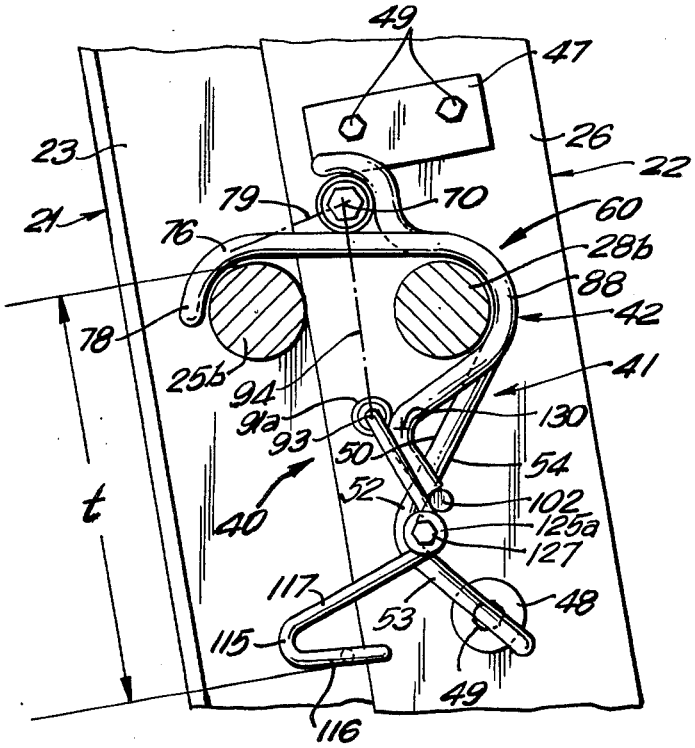

FIG. 6 is a right front elevation of the so mounted mechanism and broken-away rail sections shown in FIG. 5; and FIGS. 7, 8, 9 and 10 are further right front elevations of the so mounted mechanism and broken-away rail sections, such figures showing various positions assumed by the mechanism in response to various positionings and moments of the fly section of the FIG. 1 ladder relative to its base section.

DESCRIPTION OF THE EMBODIMENT

Figure 2:
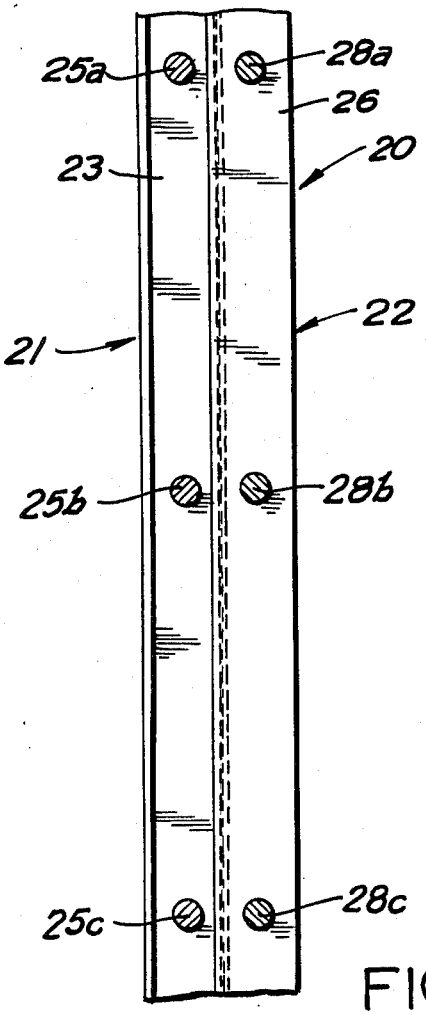
FIG. 2 is a front elevation in cross section, taken as indicated by the arrows 2—2 in FIG. 1, of a broken-away middle section of the FIG. 1 ladder.

Referring now for background to FIGS. 1 and 2, the reference numeral 20 designates a conventional extension ladder having base and fly sections 21 and 22 which are forward and rearward, respectively, relative to the other, and of which the fly section is on the climber's side of the ladder. Base section 21 comprises base rails 23 and 24 joined by a plurality of base rungs 25 of which rungs 25*a*, 25*b*, 25*c* are shown in FIG. 2. Fly section 22 comprises right and left fly rails 26 and 27 joined by a plurality of fly rungs 28 of which rungs 28*a*, 28*b*, 28*c* are shown in FIG. 2. While the rungs of the ladder are shown as solid, they may be hollow.

Each of the rails of ladder 20 is of rectangular "U" shape in cross section normal to the rail's length such that the rail has a central elongated planar rectangular web and two flanges on opposite sides of the web and salient therefrom. In the base section 21 the flanges of the rails 23, 24 project inwardly towards each other such that the two of such flanges towards the fly section 22 define with the base rungs 25 a pair of guide channels 29, 30 on opposite sides of the base section. In the fly section, the flanges of the fly rails project outwardly and the two of such flanges towards base section 21 are received in those guide channels 29, 30 so that the fly and base sections are slidably coupled together. In practice, the width of those channels is smaller than shown in FIGS. 1 and 2 to reduce to a minimum the play between the fly and base sections consonant with realizing easy sliding of either relative to the other. When ladder 20 is in use, the bottom of the base section rests on the ground or other support surface, the ladder is tilted so that its top bears against a wall or the like, and the fly section may be hoisted and subsequently lowered relative to the base section by hand or by a rope and pulley arrangement similar, for example, to that shown in U.S. Pat. No. 457,805 issued Aug. 18, 1891 in the name of J. H. Whittington and incorporated herein by reference. Ladder 20 is adapted to have mounted on each of its two fly rails 26 and 27, near their bottoms and at the same level, a respective one of two releasable lock mechanisms which are according to the invention and which are left-right mirror images of each other. The lock mechanism for the right fly rail 26 will now be described in detail.

Figure 3:
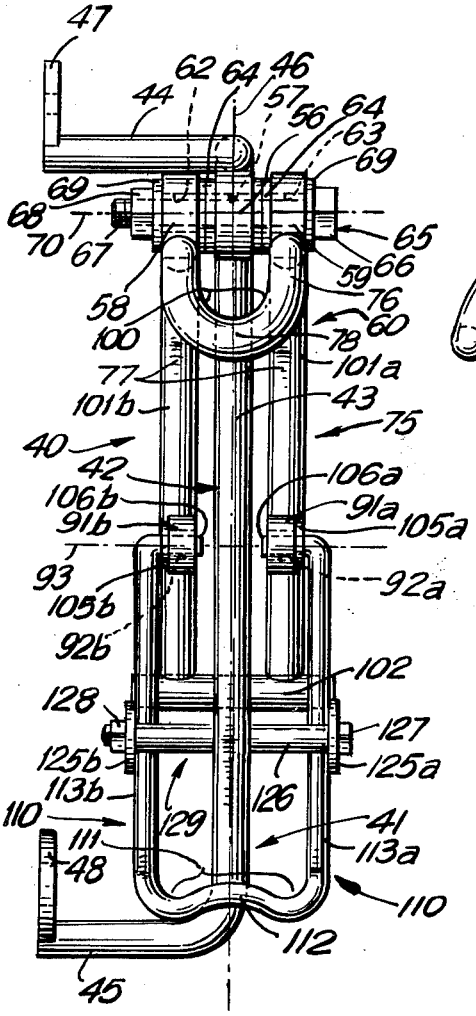
FIG. 3 is a front elevation of a releasable lock mechanism which is according to the invention, and which is adapted to be attached to the right fly rail of the FIG. 1 ladder.
Figure 4:
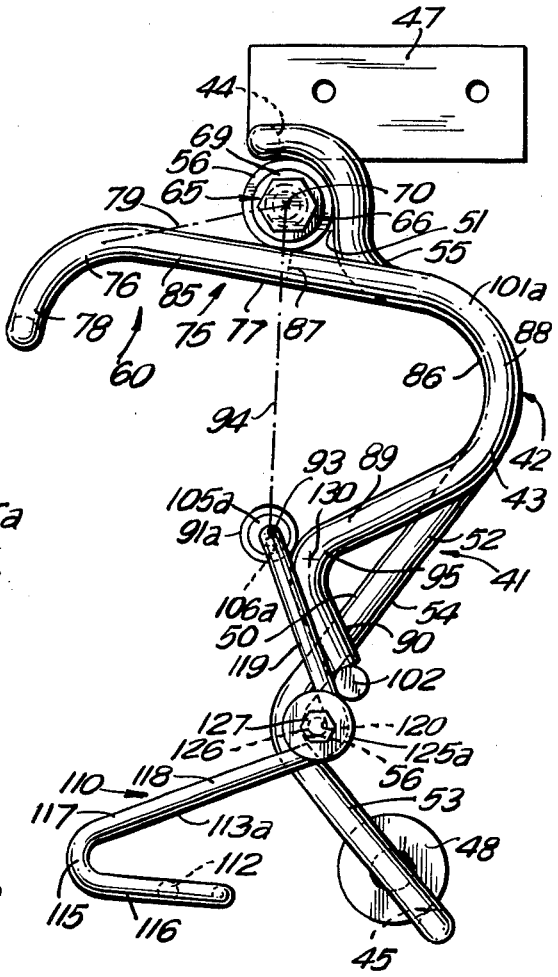
FIG. 4 is a right side elevation of the FIG. 3 mechanism.

Referring to FIGS. 3, 4 and 5, such mechanism is designated by reference numeral 40 and comprises a frame 41 of which the principal element is a shaped metal rod 42 having a central section 43 terminating at its top and bottom in "L" bends (FIG. 3) from which stub portions 44 and 45 project leftward from, and at right angles to, the center plane 46 of the frame. Top and bottom stub portions 44 and 45 are welded at their ends to respective base plates 47 and 48 having holes therein through which may be passed bolts 49 or rivets (FIG. 5) passing also through holes in the right fly rail 26 (FIG. 1) of ladder 20 to attach frame 41 in fixed relation to such rail. Central section 43 of rod 42 lies in plane 46 and is of a reverse "S" shape in which the "S" is modified to have at its top a minor bend forming an upward and rearward indentation 51, and so that the lower part of the "S" is provided by substantially linear sections 52 and 53 which are joined at an angle to form a rearward facing "U" notch 56. The upper part of the reverse "S" is constituted of a large reverse "C" bend 55 extending from its top rearwardly and downwardly.

Received in indentation 51 is a part of the frame in the form of a hub 56 welded to rod 43 and having therein a circular cylindrical bore 57 normal to plane 46. Hub 56 has on opposite sides thereof a pair of hubs 58 and 59 spaced from hub 56 and forming parts of a rung locking lever 60 and having therein respective circular cylindrical bores 62 and 63 coaxial with bore 57. A fixed spacing is maintained between inner hub 57 and outer hubs 58, 59 by a pair of washers 64 interposed between the inner hub and the outer hubs to be coaxial with the bores therein. A bolt 65 with a head 66 and a threaded stem 67 of lesser diameter than the bores in the hubs 56, 58, 59 is so disposed that its stem 67 passes from head 66 through the bores in such hubs and through the washers 64 to emerge on the opposite side where it was received thereon a self locking nut 68. Nylon bushings 69 are inserted from the outer sides of hubs 58 and 59 to pass through the bores thereof and into opposite sides of the bore 57 in hub 56 to maintain bolt 65 coaxial with all those bores and to provide bearings whereby hubs 58, 59 may angularly rotate in a substantially frictionless manner about the common axis 70 of the bolt and the hub bores. There is thus provided for lever 60 a "first" pivot through which the lever 60 is attachable via frame 41 to fly rail 26, and about which the lever is rotatable, the said common axis 70 being the pivot axis for the lever.

To describe further the details of lever 60, its principal part is a lever member 75 having a head 76 at its front and a shank 77 extending rearward from the head. As later described, head 76 is adapted to engage with ones of the base rungs 25 of ladder 20 as fly section 22 is both hoisted and lowered. To enable member 75 to better pass by these rungs when it is desired to raise the fly section, head 76 includes a downwardly slanting nose 78. The hub parts 58, 59 of lever 60 are welded to the upper side of shank 77 rearward of head 76 so that such head is separated from the mentioned first pivot with its pivot axis 70 by a first moment arm 79 (FIG. 4) represented in dot-dash line. For the purposes hereof, moment arm 79 and other later described moment arms are dimensional characteristics of the structural element to which they pertain, such arms each being a distance from a pivot for such element at which a force may act on the element to produce a moment about such pivot. Note that such force may not necessarily act normal to the direction of lie of such distance, although there ordinarily will be a component of such force which acts normal to such direction, and which determines the value of the moment.

If desired, lever 60 may be a simple lever in the sense that the significant moment arms for the lever are all either in line or closer to being in line than to being at right angles. Preferably, however, lever 60 is a bell crank lever in the sense that in addition to the first moment arm 79, it has a second moment arm primarily normal to the first arm in the sense that such second arm is either at a right angle to the first arm or is closer to being at such right angle to it than being in line with such first arm. The shown lever 60 is rendered a bell crank lever in the following manner. The full length of lever member 75 comprises two arm segments 85 and 86 having a juncture along the length of the member at about the locality indicated by dot-dash line 87. Arm segment 85 extends forwardly from such juncture and includes head 76. Arm segment 86 extends generally rearward and then downward from such juncture and is shaped to comprise an upper section 88 having a reverse "C" bend at its center and extending downward and rearward from juncture 87, a straight line section 89 extending downward and forward from the bottom of section 88 and a straight line section 90 extending downward and rearward from the bottom of section 89. Welded to the outside of the angle 95 at the juncture of sections 89 and 90 are two hubs 91*a*, 91*b* having respective bores 92*a*, 92*b* coaxial about an axis 93 normal to plane 46. The mentioned second moment arm of lever 60 is the moment arm 94 extending from first pivot 70 to axis 93 which, as later described, is the pivot axis for a "second" pivot.

While lever member 75 may be a stamped, forged, extruded or other shaped member solidly constituted throughout, to provide lightness of weight and other advantages, member 75 may, as shown, be constituted of a length of formable metal rod which is originally bent in a central portion of its length to form a "U" bend 100 (FIG. 3) and two equal length rod sections 101*a*, 101*b* extending in constant spaced relation to each other from the opposite sides of the "U" bend so as to be equidistant from center plane 46 of frame 41 when member 75 is in place. Such configuration of the rod is then further formed so that it arrives at the shape shown in FIG. 4 and so that the rod sections 101*a*, 101*b* both lie in a non-circular cylindrical surface of which the generatrix line is normal to plane 46, and the shape of which is the same as the configuration shown in FIG. 4 for member 75 to the rear of its head 76. The "U" bend in the rod provides the head of the member. The ends of the rod sections 101*a*, 101*b* away from the "U" bend are joined by a lever part constituting a brace 102 welded to the bottoms of those sections and normal to plane 46.

The hubs 91*a*, 91*b* of lever 60 have inserted in their bores 92*a*, 92*b* respective nylon bushings 105*a*, 105*b* within which in turn are two end portions 106*a*, 106*b* of a lock releasing tongue 110. While tongue 110 may be solid throughout, conveniently it is constituted of a length of metal rod originally bent at a central portion thereof to form (a) a "U" bend 111 (FIG. 3) with a dip 112 in the center of the bend, and (b) two rod sections 113*a*, 113*b* extending from the sides of the "U" bend alongside each other with a constant spacing greater than the spacing between the rod sections 101*a*, 101*b* of the lever 60. The tongue rod sections 113*a*, 113*b* are then bent in a plane normal to "U" bend 111 to each have the configuration shown in FIG. 4 so that the tongue has at its front a "U" tip 115 with a bottom 116 and a top 117 corresponding to the sides of the "U". A linear section 118 of the tongue extends upward and rearward from the "U" tip 115 and another linear section 119 extends from the top of section 118 upwardly and forwardly so as to be substantially at right angles with section 118, and so as to form therewith a forwardly facing "U" notch 120 at the same level as notch 56 in frame 41 when the frame and tongue are disposed as shown in FIG. 4. At the top of upper section 119 the two rod sections 113*a*, 113*b* are turned inwardly to provide the mentioned tongue end portions 106*a*, 106*b* which are inserted as stub shafts into the bushings 105*a*, 105*b* in the bores 92*a*, 92*b* of the hubs 91*a*, 91*b* of lever 60 so as to have a close fit with those bushings. Tongue 110 is thus attached to lever 60 through a "second" pivot of which the axis 93 of hubs 91*a*, 91*b* is the pivot axis. The reception of the stub shafts 106*a*, 106*b* of the tongue with a close fit into nylon bushings 105*a*, 105*b* permits tongue 110 to rotate about that second pivot in a substantially frictionless manner.

It will be noted from FIG. 4 that the "U" notch 120 of the tongue is disposed rearward of the "U" notch 56 of frame 41. Welded to the outer sides of the tongue's rod sections 113*a*, 113*b* on the inside (FIG. 4) of notch 120 are a pair of annular discs 125*a*, 125*b* between which is inserted a tube 126 in coaxial relation with the holes in the discs. A bolt 127 passes through the discs and, with a close fit, through such tube. Bolt 127 is capable of being loosened or tightened by rotation of a nut 128 on the bolt. The assembly of element 126–128 form a crosspiece 129. When the bolt 127 is loosened, the top of the tongue may be spread to permit its stub shaft portions 106*a*, 106*b* to be inserted into the bushings 105*a*, 106*a* in the hubs 91*a*, 91*b* of the lever 60 to thereby attach the tongue to the lever. Once that insertion has taken place, bolt 127 is tightened to draw the discs 125*a*, 125*b* against the opposite ends of tube 126 to provide a fixed spacing between the rod sections 113*a*, 113*b* of the tongue, and to maintain the stub shafts 106 inserted in the lever hubs 91.

The crosspiece 129 forms part of the tongue 110 which is adapted to cooperate with tongue guide means so that the tongue is guided in translational moment thereof relative to fly rail 26 during downward sliding of the fly section 22. Such tongue guide means is provided by the frame 41 and, more particularly, by a guide surface 54 which is formed on the rearward side of section 52 of the frame and slants upwardly and rearwardly from notch 56. Surface 54 is positionally fixed in relation to fly rail 26 when the releasable lock mechanism 40 is mounted on that rail. Crosspiece 129 is adapted during such downward sliding to act as a camming stop which bears against such surface and slides upwardly along its length to guide such translational movement of tongue 110 as later described in more detail.

When lever 60 and tongue 110 are in their positions shown in FIG. 4, the center of gravity 130 of the lever and tongue is located at or generally in the vincinity of the cross shown in FIG. 4 and identified by the reference numeral 130. Gravity center 130 is to the rear of pivot 70 and remains so for all operative positionings of the lock mechanism 40. Moreover, gravity center 130 is disposed below head 76 of lever 60 when the lever is positioned as shown in FIG. 4. To have such center so disposed is advantageous in that it promotes the stability of operation of the lock mechanism. As the lever 60 and tongue 110 assume various positions in the course of operation of the lock mechanism, the gravity center 130 will shift in its location relative to the lever and tongue and the fly rail 26, but will always remain rearward of pivot 70, and, also, below head 76 so long as lever 60 is approximately in its FIG. 4 position.

FIGS. 5 and 6 show lock mechanism 40 as attached to fly rail 26 and as in rung locking position. When mechanism 40 is so mounted and positioned, the reverse "C" bend section 55 of frame 41 extends rearward over and adjacent to fly rung 28*b* and then turns down to curve adjacently around the lock side of that rung. Similarly, the curved section 88 of the lever 60 extends rearward over and adjacent to fly rung 28*b* and then turns down to curve adjacently around the back side of such rung. Neither, however, of sections 55 and 88 contacts fly rung 28*b*.

OPERATION

FIGS. 6–10 represent how lock mechanism 40 operates during various positionings of the fly section 22 of ladder 20. Referring first to FIG. 6 which, as mentioned, shows the rung lock position for the mechanism, such position is assumed when fly section 22 is either fully retracted (i.e., fully slid down) relative to base section 21 or, alternatively, is locked in any stage of extension. In that position lever 60 is disposed so that head 76 is extended relative to the fly rail and contacts the top of the base rung 25*b*. At this time, the moment arm 79 is primarily normal to fly rail 26, and the gravity center 130 of lever 60 and tongue 110 is disposed below head 76. When fly rail 26 is extended, its weight (together with that of any ladder user on such rail) acts downward on pivot 70 to tend to drive that pivot down, while base rung 25 reacts to that downward force to produce on head 76 of the lever an upward force. Hence, there is exerted on the lever 60 a moment tending to rotate it clockwise ("CW"). That CW rotation of lever 60 is, however, prevented by the fact that the brace 102 of the lever is then bearing on the back surface 54 of the frame 41. Accordingly, such frame and brace are cooperable to provide for lever 60 a stop means which checks any further CW rotation of the lever such that its head 76 is in an uppermost limit position. As a result, the weight of fly rail 26 (and of any person on the rail) is transferred through pivot 70 and lever 60 and its head 76 to base rung 25*b*, and, because head 76 cannot move up further relative to the fly rail, the fly section 22 is locked against downward sliding relative to the base section 21. The CW moment produced by the fly rail weight on lever 60 holds brace 102 firm against the back surface of frame 41.

With lever 60 being in rung locking position as described, brace 102 of lever 60 bears against the back side of section 119 of the tongue 110. On the opposite side of the tongue at that point, the tongue's crosspiece 129 bears at notch 56 against the back sides of the sections 52 and 53 of the frame which meet to form that notch, the frame thereby providing an abutment in fixed relation with rail 26 and which stops forward movment of crosspiece 129. Accordingly, the tongue is constrained at a place remote from pivot 93 and on both of its sides from movement so that the tongue cannot rotate in either direction about such pivot. The tongue is thus prevented from flapping when lever 60 is in rung locking position and either weight is being transferred from the fly section to the base or the two sections are tied together to hold the lever in that position. The ability to so prevent flapping of tongue 110 is a significant advantage.

Brace 102 thus acts as a dual stop means because it not only sets a limit to the CCW rotation of lever 60 about pivot 70 but also checks CW rotation of tongue 110 about pivot 93. With the tongue's CCW rotation about such pivot being thus stopped, it follows that the distance in the fly rail direction of the bottom 116 of the tongue's tip 115 from the rung contacting side of lever head 76 cannot exceed a fixed value $\tau$. Such amount $\tau$ is less than the spacing between adjacent sides of adjacent base rungs but is greater than the diameter of a base rung and, preferably, is made as small as possible consonant with satisfactory operation of the lock mechanism 40.

Figure 7:
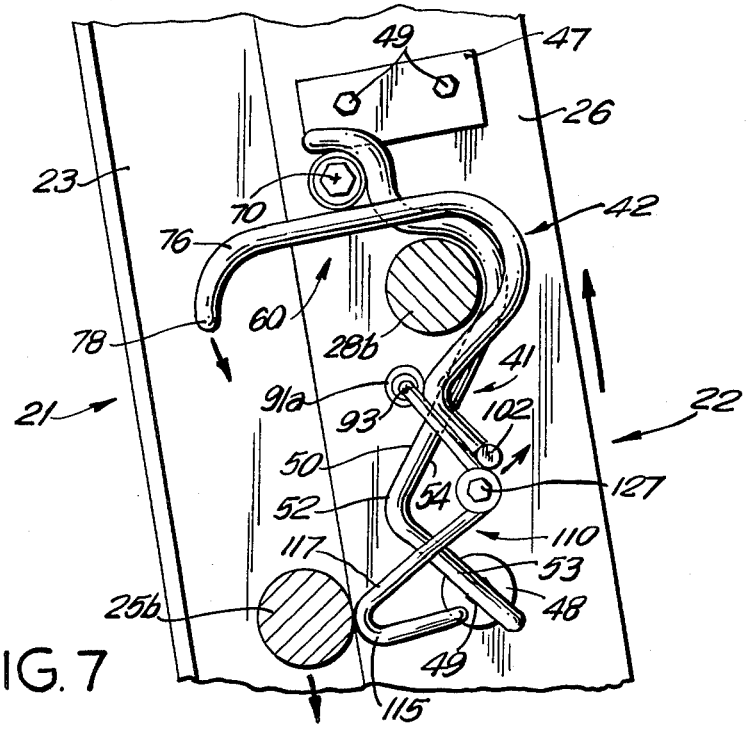

FIG. 7 shows a positioning of mechanism 40 occurring when fly section 26 is lifted relative to base section 25 from the FIG. 6 position of the fly rail by an amount less than $\tau$. In the course of such lifting, the top 117 of the tongue's tip 115 strikes the underside of base rung 25*b* to have exerted thereon from such rung a wedging force having a rearwardly directed component which exerts on the tongue 110 a counterclockwise ("CCW") moment about pivot 93. That moment is converted by the bearing of tongue 110 against brace 102 into a CCW movement of lever 60 about pivot 70. Since the head 76 of lever 60 has now become displaced upward of base rung 25*b*, lever 60 is free to rotate CCW. Hence, the mentioned wedging force of rung 25*b* on tongue 110 causes lever 60 and tongue 110 as a unit to rotate CCW about pivot 70 until the tip 115 of the tongue has moved rearward and down relative to base rail 26 from its FIG. 6 extended position to the retracted position relative to that rail which is shown in FIG. 7, and at which the tongue is in enabled to clear or pass by rung 25*b*.

Figure 8:
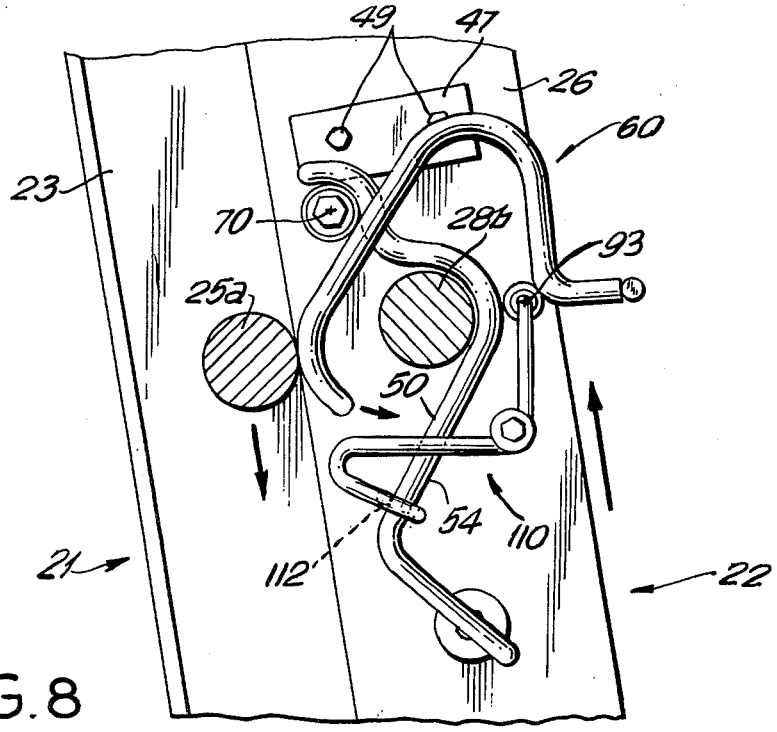

FIG. 8 shows what happens as such upward lifting of the fly rail 26 continues. With such further lifting, the top of lever head 26 first strikes the underside of base rung 25*a* and then (with more lifting) is driven by such rung rearward and downward relative to fly rail 26 from the head's previous extended position relative to such rail to the head's retracted position relative thereto which is shown in FIG. 8, and at which the lever is enabled to pass by base rung 25*a*. Such relative downward movement of lever head 76 is accompanied by CCW rotation of the lever member about pivot 70. The tongue 110 meanwhile has risen above base rung 25*b* but still has a small CCW moment thereon from its own weight. Tongue 110, therefore, tends to rotate CCW about pivot 93 but is checked in such rotation by the coming into contact of the dip 112 (FIG. 3) of the tongue's tip 115 with the forward surface 50 of the frame 41. Once that contact has been made, such dip slides upwardly along such surface to provide for tongue 110 a guided translational movement relative to fly rail 26 which forces the tongue to rotate CW about pivot 93.

When, with more lifting of the fly rail, the lever 60 passes rung 25*a*, and lever head 26 is relieved from the downward force thereon from the rung 25*a*. The weight of the lever and tongue then come into play to produce on the lever a CW moment about pivot 70 and a resulting CW rotation of the lever about such pivot to restore the lever and tongue to (or approximately to) their positions relative to rail 26 which are shown in FIG. 6. Hence, providing that the lever head 76 has been raised above rung 25*a* by less than the amount $\tau$, a subsequent lowering of the fly rail will cause the head to settle on rung 25*a* and the fly section 21 to be locked through that rung to the base section 22 as previously described in connection with FIG. 6. In this manner, the fly section may be raised above the base section by one or more base rungs as desired and then locked to the base section to be prevented from downward sliding relative thereto.

Suppose, however, that starting with the FIG. 6 position, it is desired to lower the fly section 22 relative to base section 21. That may be accomplished in the manner illustrated in FIGS. 9 and 10.

As an initial step, the fly rail 26 is raised so that the tongue 110 passes by base rung 25*b* as described in connection with FIG. 7. As a difference, however, instead of continuing to raise the fly rail so that lever 60 passes by the next higher base rung 25*a* (as described in connection with FIG. 8), after the fly rail has been raised from its FIG. 6 position by more then the amount $\tau$, the fly rail is lowered. When this is done, the bottom arm 116 of tongue tip 115 strikes the top of base rung 25*b* (FIG. 9) while the lever head 76 is at a location between two base rungs.

When the tongue tip bottom arm 116 is struck by base rung 25, there is, due to the slant of such bottom arm, a wedging force exerted by the rung on tongue 110 which produces a moment tending to rotate tongue 110 CCW about pivot 93. Such a moment produced by such a wedging force has in the past been used in hood-and-keeper lock mechanisms for moving the hook to enable it and the keeper to pass by one or more base rungs when downward sliding of the fly section is desired. In, however, the mechanism 40 now being described, such CCW moment is overcome by a much greater CW moment produced on tongue 110 about pivot 93 by the upward component of force which is exerted by the base rung 25*b* on the tongue tip bottom 116, and which is in the direction of the length of base rail 23.

If no constraint were to be imposed on the effect of such CW moment on tongue 110, the tongue would merely rotate freely CW about pivot 93 so as to leave lever 60 in its extended position at which its head would be incapable of passing base rung 25 as the fly rail 23 is slid down. In the described mechanism, however, such a constraint is imposed on CW rotation of the tongue by the cooperation of the tongue 110 with the frame 41 and, more particularly, by the cooperation of the camming stop 129 of the tongue with the guide surface 54 of the frame. Specifically, when the tongue 110 is in the position shown in FIG. 9, stop 129 bears against guide surface 54 to prevent unrestricted CW rotation of tongue 110 about pivot 93. Hence, the upward force from rung 25 on tongue tip 115 results in an upward driving of that tip (and of the rest of the tongue 110) relative to fly rail 26 which primarily involves an upward translational movement of the tongue relative to such rail, and which is accompanied by an upward sliding of stop 129 along guide surface 54, so that such translational movement is guided by such surface. While the tongue thus undergoes a guided upward translational movement, it also undergoes a concurrent restricted amount of CW rotation about pivot 93. Such restricted pivoting movement of the tongue can perhaps be better envisaged by considering the linear section 119 of the tongue, and by noting that it extends, on the one hand, to the pivot 93 which can move around pivot 70 (at a fixed distance represented by movement arm 94) and, on the other hand, to the camming stop 129 which also acts as a movable pivot but is constrained in the FIG. 9 situation to follow the path defined for it by guide surface 54, the two pivots 93 and 129 being kept apart a fixed distance by such tongue section 119.

Figure 9:
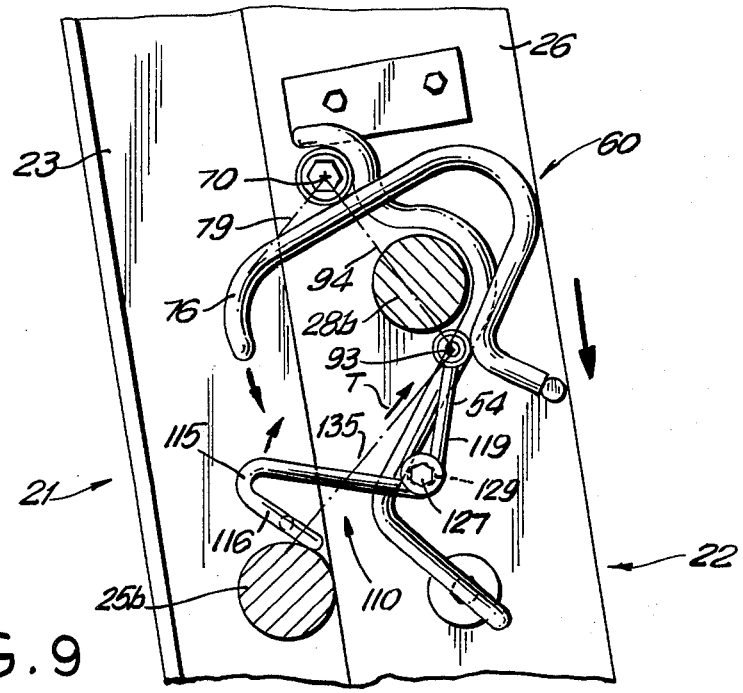

With the movement on tongue 110 being controlled in the FIG. 9 situation in the manner described, the result is that the tongue tip 115 is driven by base rung 25*b* to move upward relative to rail 26 towards closure with lever head 76, and that such upward movement of the tip is converted by the guided translational movement of tongue 110 and the restricted pivoting thereof into a CCW pivoting of lever 60 which shifts its head 76 downward and rearward relative to rail 26 and towards closure with tongue tip 115. Note that the guided upward translational movement of tongue 110 is properly directed to produce such CCW pivoting of lever 60, and that the restricted CW rotation of tongue 110 about the pivot provided by element 129 also is properly directed to contribute to the CCW pivoting of lever 60. Thus the guided translational movement of tongue 110 and the restricted CW rotation thereof superimposed on such translational movement work together to each contribute towards the desired CCW pivoting of lever 60.

How such guided translational movement of tongue 110 and its concurrent restricted CW movement about stop 129 so work together to produce CCW pivoting of lever 60 in FIG. 9 can perhaps be better understood by considering that the forces on pivot, 93 from these two movements of the tongue are replaced by the shown (FIG. 9) single thrust "T" of the tongue against such pivot in the direction of the shown dot-dash line 135 from the bottom 116 of tongue tip 115 to the pivot 93. Initially the thrust "T" is at an obtuse angle to moment arm 94 of the bell crank lever 60 so that the component of T which is normal to arm 94 (and determines the value of the moment associated with that arm) is not maximum. As, however, the CCW pivoting of the lever 60 about pivot 70 progresses, the thrust T shifts in angle relative to moment arm 94 so that "T" eventually becomes normal to that arm to maximize the CCW moment which is associated with that arm, and which drives lever 60 in the CCW direction.

The upward and downward movements of, respectively, tongue tip 115 and lever head 76 (relative to fly rail 26) which have been described in connection with FIG. 9 are movements which continue (as the fly section 22 is slid down relative to base section 21) until the lock mechanism reaches the condition shown in FIG. 10. In that condition, the CCW pivoting of lever 60 induced by the thrust "T" from tongue 110 has shifted the lever head 76 down from its FIG. 9 extended position to a retracted position relative to fly rail 26, and at which the head (and thus the entire lever 60) is enabled to pass base rung 25*b* as the fly rail slides down. Concurrently, and partly by virtue of the fact that the frame surface 54 for guiding translational movement of tongue 110 slants not only upwardly from its bottom but also rearwardly therefrom, the combination of the guided translational movement of tongue 110 and its restricted CW rotation about pivots 93 and 129 has shifted the tongue tip 115 from its FIG. 9 extended position to the retracted position shown in FIG. 10, and at which the tip (and thus the entire tongue 110) is enabled to pass by base rung 25 as fly section 22 slides downward. Accordingly, in the course of such downward sliding, the mechanism 40 will pass that rung and will then be caused by the weight of its components to return to a configuration approximately that shown in FIG. 7, except that the tongue tip 115 will be disposed in extended position above the next lower base rung 25*c*. With further downward sliding of the fly section 22, the bottom 116 of the tip will strike the top of such next lower rung, and the movements described in connection with FIGS. 9 and 10 will be repeated. In this manner, the fly section may be slid down as far as desired within the capabilities of ladder 20. Having reached the end point of such downward sliding, the fly section may then be lifted and subsequently lowered (as described in connection with FIG. 8) to again lock the fly section to the base section.

Figure 10:
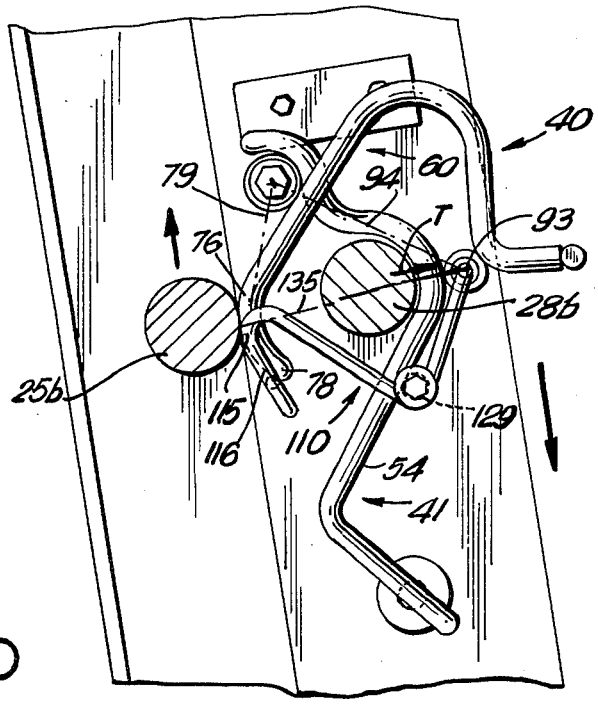

As illustrated in FIG. 10, when the mechanism 40 has reached the configuration where both the lever head 76 and tongue tip 115 are in retracted position relative to fly rail 26 (so as to both be capable of passing base rung 25*b* during downward sliding of the fly section), both of elements 76 and 115 have moved not only towards closure with each other but beyond such closure so that the two elements overlap. That overlap is made possible by the fact (FIG. 3) that the rod sections 113*a*, 113*b* of the tongue 110 are spaced far enough apart to be able to straddle the "U" bend 100 of lever head 76 when the head and tongue are brought into proximate relation as in FIG. 10. The ability of the lever head and the tongue tip to so overlap is advantageous because it permits the head and tip to be spaced relatively close to each other in the direction of the fly rail while concurrently enabling both to simultaneously pass by base rungs. Also, the overlap allows the rung to be brought into the position shown in FIG. 10 without the lever head being released before the base rung has been passed.

A further matter of interest is that, as the elements of mechanism 40 shift from their positions shown in FIG. 9 to those shown in FIG. 10, the thrust "T" of the tongue makes with the moment arm 94 of the bell crank lever 60 an angle which progressively changes so as to be first an obtuse angle (FIG. 9) slightly greater than a right angle, then a right angle and then (FIG. 10) an acute angle somewhat smaller than a right angle. Hence, during the change of mechanism 40 from its FIG. 9 configuration to its FIG. 10 configuration, the average direction of thrust "T" is such as to produce the maximum moment by such thrust on lever 60. Moreover, during the first part of such change, the thrust "T" is progressively approaching nearer to its right angle orientation with moment arm 94 at which the thrust is directed to produce such maximum moment.

The hereby disclosed lock mechanism 40 has numerous advantages of which ones not already mentioned are as follows. The bulk of the mechanism 40 is below the fly rung adjacent thereto so as to be out of the way of the ladder user. It is not necessary in order to use mechanism 40 to omit a rung on the extension ladder. The mechanism is versatile in that it can be used in a wide variety of extension ladders (e.g., wood, metal, fiberglass), and the same model of mechanism can be used on ladders which differ substantially from each other in respect of the size and shape of their rungs and/or the spacing between rungs. The mechanism, being gravity operated, requires no springs or other non-rugged parts which are likely to get out of order. The design of the mechanism is such that it has no parts which can project out beyond the non-climber's side of the base section, and which thus can be easily damaged. The mechanism during its operation mostly remains wholly within the confines of the fly section to thereby shield most of its parts from damage incurred as a result of such parts projecting on the climber's side out beyond the fly section.

The above-described embodiment being exemplary only, it will be understood that additions thereto, omissions therefrom and modifications thereof can be made without departing from the spirit of the invention. Thus, for example without restriction, the section 88 of lever member 75 may, while not preferred but if desired, contact fly rung 28*b* (FIG. 6) when lever 60 is in rung locking position so that the rung acts as an auxiliary or emergency stop for such lever.

Accordingly, the invention is not to be considered as limited save as is consonant with the recitals of the following claims.

What is claimed is:

1. A releasable lock mechanism for an extension ladder having slidably coupled base and fly sections located, respectively, relatively forward and rearward of the other, and each comprising side rails and rungs, said mechanism comprising: a rung locking lever having a head at its front and attachable on a fly rail of the ladder through a first pivot to be rotatable thereabout to move said head between positions which are extended and retracted, respectively, relative to such rail and up and down, respectively, relative to the other, and at which such head is adapted to engage the top of and to pass by, respectively, ones of the ladder's base rungs, said head being spaced from said first pivot by a first moment arm, stop means cooperable with said rail and lever to check upward movement of the fully extended head at an uppermost limit position at which such moment arm is primarily normal to said rail, and said head is adapted by engaging the top of a base rung to lock the ladder's fly section against downward sliding, a lock releasing tongue having at one end a tip and attached at its other end to said lever through a second pivot to be rotatable thereabout to move said tip between retracted and extended positions at which, respectively, such tip is adapted to pass by and to be engaged by ones of such base rungs, said second pivot being spaced from said first pivot by a second moment arm, and said tip being adapted during downward sliding of said fly rail to be struck from underneath by successive of said base rungs to be displaced primarily upward thereby relative to said fly rail so as to undergo with each such upward displacement a closing pivoting movement relative to said head, and tongue guide means cooperable with said fly rail and tongue for converting such closing pivoting movements into thrusts exerted by said tongue at said second pivot on said lever to produce pivotings thereof about said first pivot which shift said head from extended to retracted position to enable said lever to pass by such base rungs in the course of such downward sliding.

2. A mechanism according to claim 1 in which said rung locking lever is a bell crank lever having first and second fixedly joined arm segments and having said head at the front of said first segment, said tongue being attached through said second pivot to part of said second segment remote from the juncture of said segments, and said head and second pivot being disposed relative to said first pivot to render said first and second moment arms primarily normal to each other.

3. A mechanism according to claim 2 in which said bell crank lever is attachable on said fly rail through said first pivot so that said second arm segment passes downwardly to the rear of the back side of a fly rung of said ladder.

4. A mechanism according to claim 1 in which said stop means is cooperable with said tongue to check pivoting movement of said tongue away from said lever at an angular position of the former relative to the latter at which said tip is maintained in extended position when said head is in fully extended position.

5. A mechanism according to claim 1 in which said stop means comprises a frame attachable to said fly rail and, also, a stop portion of said lever adapted upon upward movement of said head relative to said fly rail to engage said frame to thereby check the head movement at said upper limit position.

6. A mechanism according to claim 5 in which said stop portion is disposed away from said second pivot in the path followed by said tongue in the course of pivoting movement thereof away from said lever, said stop portion being adapted by engaging said tongue to check such movement at an angular position of said tongue relative to said lever at which said tip is maintained in extended position when said head is in fully extended position.

7. A mechanism according to claim 1 in which said guide means is cooperable with said fly rail and tongue to convert said closing pivoting movements of said tip into thrusts exerted by said tongue on said lever at said second pivot and directed in relation to said second moment arm to initially shift in angle relative thereto so as to progressively approach closer to a right angle relation therewith as the distance between head and tip diminishes in the course of said closing movements.

8. A mechanism according to claim 1 in which said guide means is definitive of a path fixed in position relative to said fly rail, and said guide means is adapted to cause translational movement of said tongue to follow said path in the course of such closing pivoting movements of said tip.

9. A mechanism according to claim 8 in which said guide means comprises a frame mountable on said fly rail and providing a guide surface definitive of said path, said guide means further comprising a camming portion of said tongue adapted by slidably contacting said guide surface to cause said translational movement of said tongue to follow said path.

10. A mechanism according to claim 9 in which said frame is cooperable with a stop portion of said lever to provide said stop means.

11. A mechanism according to claim 1 in which said stop means and guide means are cooperable with said tongue to hold it against flapping when said head is in engagement with a base rung.

12. A releasable lock mechanism for an extension ladder having slidably coupled base and fly sections located, respectively, forward and rearward of the other, and each comprising side rails and rungs, said mechanism comprising: a bell crank lever with first and second fixedly joined arm segments primarily normal to each other and with a head at the front of said first segment, said lever being attachable to a fly rail of said ladder through a first pivot so that said first and second segments extend forwardly and downwardly, respectively, from their juncture, and said lever being rotatable about such pivot to move said head between positions which are extended and retracted, respectively, as to such rail and up and down, respectively, as to each other, and at which said head is adapted to engage with and pass by, respectively, ones of the base rungs of said ladder, said head being spaced from said first pivot by a first moment arm primarily normal to such fly rail when said head is in fully extended position; stop means cooperable with said bell crank lever and fly rail to check upward movement of said head at an uppermost limit position at which said head is adapted by engaging the top of a base rung to lock said fly section against downward sliding, and a lock releasing tongue having a tip at one end and attached at its other end to a lower part of said second arm segment through a second pivot spaced from said first pivot by a second moment arm primarily normal to said first moment arm, said tongue being rotatable about said second pivot to move said tip between extended and retracted positions at which said tip is adapted to be contacted by and to pass by, respectively, ones of said base rungs, and said tongue being responsive during downward sliding of said fly section to strikings of said tip from underneath by successive of said base rungs to exert thrusts at said second pivot on said lever to produce pivotings thereof about said first pivot which shift said head from extended to retracted position to enable said lever to pass by such rungs in the course of such downward sliding.

13. A releasable lock mechanism for an extension ladder comprising: a rung locking lever attachable to a fly rail of such ladder through a first pivot and having a head spaced from such first pivot by a first moment arm primarily normal to said rail when said head is in its uppermost position relative to said rail, said head being operable when checked from primarily upward movement relative to said rail and contacting a base rung of said ladder to lock the fly section thereof from downward sliding; a lock releasing tongue having at one end a tip and attached at its other end to said lever through a second pivot spaced from said first pivot by a second moment arm, said tongue during downward sliding of said fly section being operable by guided translational movement of said tongue and pivoting movement thereof to convert an upward driving of said tip relative to said head by a base rung of said ladder into a pivoting of said lever which shifts said head primarily down relative to said rail to enable it to pass by such rung; and means to so check such upward movement of said head and to effect such guided movement of said tongue.

14. A mechanism according to claim 13 further comprising a frame attachable in fixed relation to said fly rail and coupled to said lever by said first pivot to render said lever attachable to said frame through such pivot.

15. A mechanism according to claim 14 in which said frame is cooperable with said lever to provide means to check such upward movement of said head relative to said fly rail.

16. A mechanism according to claim 14 in which said frame is cooperable with said tongue to provide means to effect such guided movement of said tongue.

17. A mechanism according to claim 14 in which said frame is cooperable with both said lever and said tongue to provide means to check such upward movement of said head and to effect such guided movement of said tongue.

18. A mechanism according to claim 13 in which said lever is a bell crank lever comprising a length of metal rod having centrally formed in its length a "U" bend providing the head of said lever, and from which extend two elongated rod sections providing the shank of said lever and lying to either side of the center plane of said lever, said rod sections being shaped so that said shank has first and second joined arm segments disposed in bell crank relation to each other, and as to which said "U" bend is at the front of said first segment, said lever further comprising means proximate the juncture of said segments for attaching said lever to said fly rail through said first pivot, means for attaching said tongue through said second pivot to part of said second arm segment remote from said juncture, and a brace coupling together said two rod sections at their ends remote from said "U" bend.

19. A mechanism according to claim 18 in which said means for checking such upward movement of said head comprises a frame attachable at its ends to said fly rail and having between said ends an elongated section disposed between said rod sections of said lever, said brace being adapted by engagement with said frame to check such upward movement.

20. A mechanism according to claim 13 in which said tongue comprises a length of metal rod having centrally formed in its length a "U" bend providing said tip of said tongue and from which extend two rod sections lying to either side of the center plane of said tongue and coupled at their ends remote from said bend through said second pivot to said lever.

21. A mechanism according to claim 20 in which said means for effecting said guided movement of said tongue comprises (a) a frame attachable to said fly rails and having thereon a guide surface, and (b) a crosspiece forming part of said tongue and extending between said rod sections thereof, said crosspiece being adapted by sliding contact over such surface to effect such guided movement.

22. A mechanism according to claim 21 in which said crosspiece is spaced from said second pivot, and said lever is operable upon occurrence of a bearing contact of said head with the top of a base rung to press said crosspiece against said guide surface to thereby hold said tongue against flapping.

23. A releasable lock mechanism for an extension ladder comprising a rung locking lever attachable to a fly rail of said ladder through a first pivot and having at its front a head spaced from such first pivot by a first moment arm primarily normal to such rail when said head is at an uppermost limit position relative to said rail at which said head is engagable with a base rung of the ladder to lock its fly section against downward sliding, a lock releasing tongue having at one end a tip and attached at its other end to said lever through a second pivot spaced from said first pivot by a second moment arm, the center of gravity of said lever and tongue being below said head when it is in said limit position, and tongue guide means attachable in fixed relation to said rail and responsive during downsliding of said fly section to upward drivings of said tip relative to said rail by striking of said tip by ladder base rungs to guide said tongue to undergo a translational movement thereof which pivots said lever to drive said head down relative to said rail, said head and tip being positionable by such respective drivings thereof to enable both of them to pass such rungs in the course of such downsliding.

24. The improvement in a releasable lock mechanism for an extension ladder comprising: rung locking means attachable to a fly rail of such ladder so as to be movable between first and second positions at which, respectively, such means is engagable with base rungs of said ladder to prevent downsliding of its fly section and is non-engagable with such rungs to permit such downsliding, and lock releasing means attached to said rung locking means and responsive to a striking thereof by each of ones of such rungs to move said rung locking means from said first to said second position, said improvement comprising: stop means attachable to said rail to provide in fixed relation therewith an abutment against which part of said releasing means is pressable by part of said rung locking means when in said first position so as, while in such position, to maintain said releasing means stationary.

25. A releasable lock mechanism for an extension ladder comprising: a rung locking lever attachable to a fly rail of such ladder through a first pivot and having a head spaced from such first pivot by a first moment arm, said head being operable when checked from upward movement relative to said rail and contacting a base rung of said ladder to lock the fly section thereof from downward sliding; a lock releasing tongue having at one end a tip and attached at its other end to said lever through a second pivot spaced from said first pivot by a second moment arm, means for controlling movement of said tongue whereby said tongue during downward sliding of said fly section is operable to convert an upward driving of said tip relative to said head by a base rung of said ladder into a pivoting of said lever which shifts said head down relative to said rail to enable it to pass by such rung; and means to so check such upward movement of said head.

26. A releasable lock mechanism according to claim 25 in which said rung locking lever is a bell crank lever with said first and second moment arms thereof being primarily normal to each other.

27. A release lock mechanism according to claim 25 in which said head and tip have respective constructions enabling one to straddle the other, and in which said upward driving of said tip relative to said head produces first a relative closure thereof and then an overlapping thereof.

* * * * *